US011423868B2

(12) United States Patent
Matsuba et al.

(10) Patent No.: US 11,423,868 B2
(45) Date of Patent: Aug. 23, 2022

(54) KEYBOARD DEVICE AND MUSICAL SOUND EMISSION METHOD

(71) Applicant: Roland Corporation, Shizuoka (JP)

(72) Inventors: Masaaki Matsuba, Shizuoka (JP); Takahiro Murai, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 17/387,946

(22) Filed: Jul. 28, 2021

(65) Prior Publication Data

US 2022/0189436 A1 Jun. 16, 2022

(30) Foreign Application Priority Data

Dec. 16, 2020 (JP) ..... JP2020-208255

(51) Int. Cl.

| | |
|---|---|
| ***G10C 3/06*** | (2006.01) |
| ***G10C 3/04*** | (2006.01) |
| ***G10H 1/32*** | (2006.01) |
| ***G10C 1/00*** | (2006.01) |

(52) U.S. Cl.

CPC ..... *G10C 3/06* (2013.01); *G10C 1/00* (2013.01); *G10C 3/04* (2013.01); *G10H 1/32* (2013.01); *G10H 2220/311* (2013.01)

(58) Field of Classification Search

CPC ... G10C 3/06; G10C 1/00; G10C 3/04; G10H 1/32

See application file for complete search history.

(56) References Cited

U.S. PATENT DOCUMENTS

| | | | | |
|---|---|---|---|---|
| 1,664,556 A * | 4/1928 | Hammond, Jr. | G10C 3/06 | 84/182 |
| 1,670,352 A * | 5/1928 | Hammond, Jr. | G10C 3/06 | 84/182 |
| 2,351,497 A * | 6/1944 | Fomeen | G10D 13/08 | 84/170 |
| 5,789,693 A * | 8/1998 | Lawson | G10H 1/32 | 84/DIG. 1 |
| 7,002,070 B2 * | 2/2006 | Katz | G10H 1/32 | 84/718 |

(Continued)

FOREIGN PATENT DOCUMENTS

| | | |
|---|---|---|
| JP | 2006189736 | 7/2006 |
| JP | 2008241760 | 10/2008 |

(Continued)

*Primary Examiner* — Robert W Horn

(74) *Attorney, Agent, or Firm* — JCIPRNET

(57) ABSTRACT

A keyboard device and a musical sound emission method are provided. A top lid is formed into a hollow structure including a lower plate and an upper plate facing the lower plate. Since vibrating bodies are fixed to an inner surface of the lower plate, the vibrating bodies can cause the lower plate to vibrate and thereby emit musical sound generated through the vibration from an outer surface side of the lower plate to the outside. On the other hand, the musical sound emitted from an inner surface side of the lower plate is blocked by the upper plate, and it is thus possible to curb mutual cancelation of musical sound in opposite phases emitted from each of the inner surface and the outer surface of the lower plate. Therefore, it is possible to efficiently emit musical sound to the surroundings of the top lid.

20 Claims, 5 Drawing Sheets

(56) References Cited

U.S. PATENT DOCUMENTS

| | | | | |
|---|---|---|---|---|
| 7,897,856 | B2 * | 3/2011 | Shinjo | G10H 1/32 84/2 |
| 8,859,866 | B2 * | 10/2014 | Onishi | G10C 3/06 84/723 |
| 8,962,966 | B2 * | 2/2015 | Ohnishi | G10C 3/04 84/718 |
| 9,012,758 | B2 * | 4/2015 | El-Khadem | G10H 3/18 84/723 |
| 9,177,539 | B2 * | 11/2015 | Faccioni | G10D 3/02 |
| 9,245,509 | B2 * | 1/2016 | Fujiwara | G10C 3/06 |
| 9,311,905 | B2 * | 4/2016 | Murakami | G10H 3/26 |
| 9,779,712 | B2 * | 10/2017 | Ohnishi | G10H 3/146 |
| 9,959,843 | B2 * | 5/2018 | Ohnishi | G10H 3/146 |
| 9,978,346 | B2 * | 5/2018 | Oberg | G10H 3/185 |
| 10,192,534 | B2 * | 1/2019 | Yudasaka | H04R 9/06 |
| 10,777,170 | B2 * | 9/2020 | Ognibeni | G10C 3/06 |
| 11,146,872 | B2 * | 10/2021 | Matsuba | H04R 9/045 |
| 11,252,502 | B2 * | 2/2022 | Matsuba | G10H 1/32 |
| 2013/0061733 | A1 | 3/2013 | Ohnishi et al. | |
| 2013/0092007 | A1 | 4/2013 | Ohnishi et al. | |
| 2013/0118333 | A1 | 5/2013 | Ohnishi et al. | |
| 2017/0094413 | A1 * | 3/2017 | Satoh | G10C 1/00 |
| 2022/0189436 | A1 * | 6/2022 | Matsuba | G10C 3/06 |

FOREIGN PATENT DOCUMENTS

| | | |
|---|---|---|
| JP | 2010-152231 | 7/2010 |
| JP | 2016-206222 | 12/2016 |

* cited by examiner

KEYBOARD DEVICE AND MUSICAL SOUND EMISSION METHOD

CROSS-REFERENCE TO RELATED APPLICATION

This application claims the priority benefit of Japan application serial no. 2020-208255, filed on Dec. 16, 2020. The entirety of the above-mentioned patent application is hereby incorporated by reference herein and made a part of this specification.

BACKGROUND

Technical Field

The present disclosure relates to a keyboard device and a musical sound emission method and particularly to a keyboard device and a musical sound emission method capable of efficiently emitting musical sound to the surroundings of an opening/closing member.

Description of Related Art

A keyboard device with a part of a casing opened and closed by a plate-shaped opening/closing member is known. For example, Patent Document 1 describes a technique of attaching a vibration generator TR1 (vibrator) to a top lid 1001 (opening/closing member) of a grand piano 1000 and causing the vibration generator TR1 to vibrate on the basis of musical sound signals in accordance with pressed keys. According to the technique, it is possible to cause the top lid 1001 to be vibrated by the vibration generator TR1 and thereby to emit musical sound generated by the vibration to the surroundings of the top lid 1001.

PATENT DOCUMENTS

[Patent Document 1] Japanese Patent Laid-Open No. 2016-206222 (Paragraphs [0058] and [0086] and FIG. 14, for example)

However, according to the aforementioned technique in the related art, musical sound in mutually opposite phases is emitted from both upper and lower surfaces of the opening/closing member, and the musical sound in the opposite phases may be canceled out. Therefore, there is a problem that musical sound cannot be efficiently emitted to the surroundings of the opening/closing member.

SUMMARY

According to an embodiment, there is provided a keyboard device including: a casing; an opening/closing member that opens and closes a part of the casing; and vibrating bodies that are attached to the opening/closing member and vibrate on the basis of a musical sound signal when a key is pressed, the opening/closing member being formed into a hollow structure including a first plate and a second plate facing the first plate, and the opening/closing member being caused to vibrate to emit musical sound through vibration of the vibrating bodies fixed to an inner surface of the first plate.

According to an aspect of the present disclosure, there is provided a musical sound emission method performed by a keyboard device including a casing, an opening/closing member that opens and closes a part of the casing, and vibrating bodies that are attached to the opening/closing member and vibrate on the basis of a musical sound signal when a key is pressed, the opening/closing member being formed into a hollow structure including a first plate and a second plate facing the first plate, the method including: causing the opening/closing member to vibrate to emit musical sound through vibration of the vibrating bodies fixed to an inner surface of the first plate.

DESCRIPTION OF THE EMBODIMENTS

The disclosure provides a keyboard device and a musical sound emission method capable of efficiently emitting musical sound to the surroundings of an opening/closing member.

Figure 1:
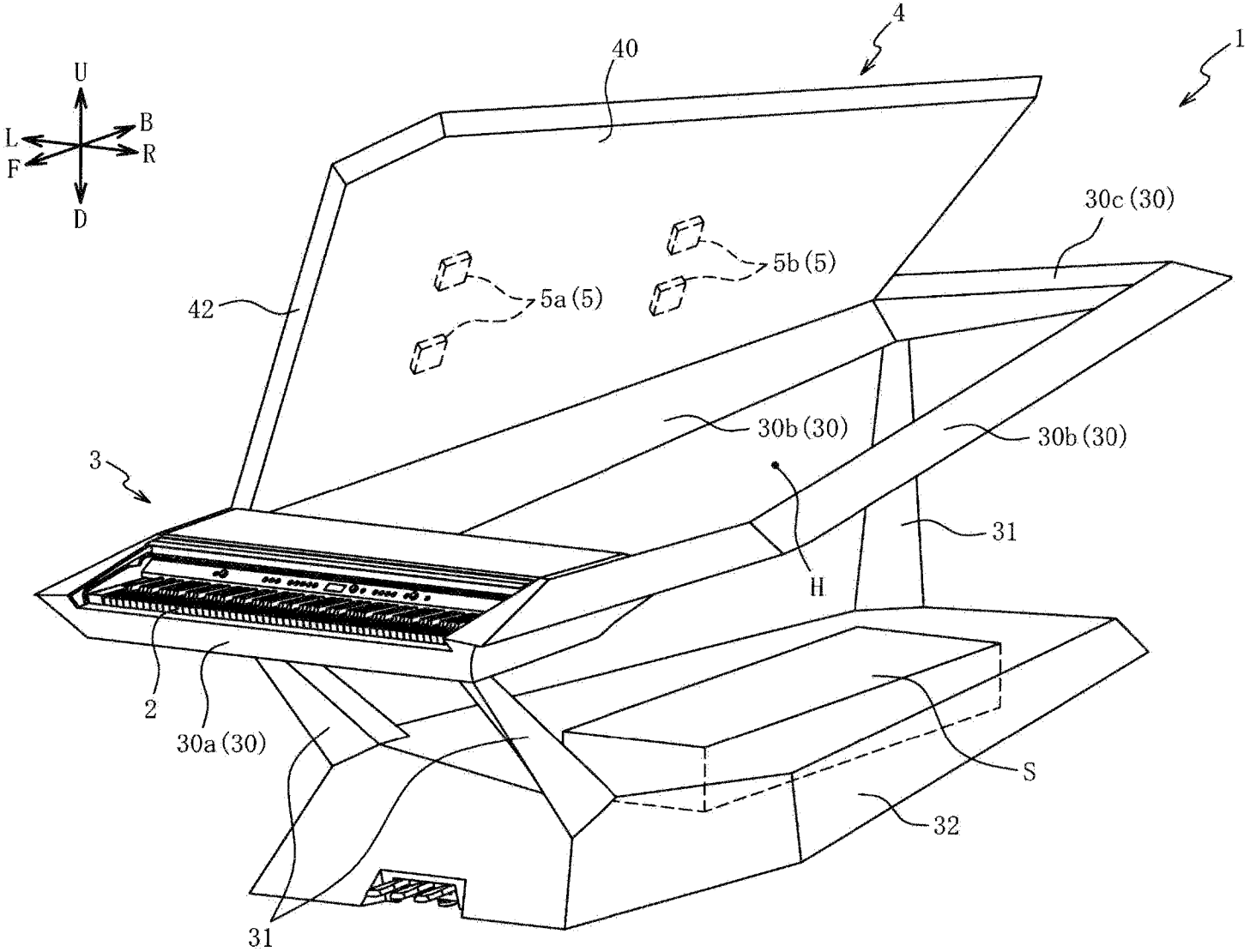
FIG. 1 is a front perspective view of a keyboard device according to an embodiment.

Hereinafter, a preferred embodiment will be described with reference to the accompanying drawings. First, an overall configuration of a keyboard device 1 will be described with reference to FIG. 1. FIG. 1 is a front perspective view of the keyboard device 1 according to an embodiment. FIG. 1 illustrates a state in which a top lid 4 opens a cavity H of a casing 3. Also, the arrow U direction, the arrow D direction, the arrow F direction, the arrow B direction, the arrow L direction, and the arrow R direction in FIG. 1 indicate an upward direction, a downward direction, a forward direction, a backward direction, a left direction, and a right direction in the keyboard device 1 seen from a side of a player, respectively, and the same applies to FIG. 2 and the following drawings.

As illustrated in FIG. 1, the keyboard device 1 is configured as a keyboard musical instrument (electronic piano) including a plurality of (eighty-eight in the present embodiment) keys 2 played by the player and the casing 3 that supports the plurality of keys 2.

The casing 3 includes a main body part 30 that supports the plurality of keys 2, a plurality of (three in the present embodiment) leg parts 31 extending downward (on the arrow D side) from the main body part 30, and a base part 32 that supports the main body part 30 via the plurality of leg parts 31.

A portion of the main body part 30 on a front end side (arrow F side) is configured as a keyboard table 30*a* that supports the keys 2, and a pair of transverse frames 30*b* extend backward (arrow B side) from both left and right (arrow L-R direction) end parts of the keyboard table 30*a*. Back end parts of the pair of transverse frames 30*b* are connected (coupled) to each other with a back frame 30*c*, and the cavity H surrounded by the keyboard table 30*a*, the transverse frames 30*b*, and the back frame 30*c* is formed in the main body part 30.

The top lid 4 is rotatably attached, via a hinge, which is not illustrated, to the transverse frame 30*b* located on the left side (arrow L side) of the pair of left and right transverse frames 30*b*, and the cavity H of the main body part 30 is opened and closed by the top lid 4. The top lid 4 is formed into a plate shape simulating a top lid (topboard) of a grand piano.

Since the top lid 4 is configured to be rotatable about the rotation axis along the transverse frames 30*b* (front-back direction), a lower plate 40 configuring the lower surface of the top lid 4 is configured to face a side (arrow R side) of the main body part 30 when the top lid 4 is lifted to open the cavity H. Since the state in which the top lid 4 opens the cavity H is configured to be fixed with a fixing tool, which is not illustrated, it is possible to switch between a state in which the cavity H is closed by the top lid 4 (closed state) and a state in which the cavity H is opened (opened state).

The pair of leg parts 31 extend downward from both the left and right end parts of the keyboard table 30*a* (the front end part of the main body part 30), and one leg part 31 extends downward from a connecting part (a back end part of the main body part 30) between the transverse frame 30*b* on the left side and the back frame 30*c*. Lower end parts of the three leg parts 31 are connected (coupled) to the base part 32 that serves as a seating of the casing 3.

A base part speaker S is provided inside the base part 32, and musical sound is emitted from the upper surface of the base part speaker S when the keys 2 are pressed. More specifically, the keyboard device 1 includes a switch (not illustrated) that is turned on/off through vibration of each key 2 when the player operates (presses or releases) the key, and key pressing information (note information) is detected according to an on/off operation of the switch. Musical sound based on the key pressing information is output from the base part speaker S by a musical sound signal based on the detection result being output to the base part speaker S.

In this manner, the configuration in which the base part speaker S is accommodated in the base part 32 that serves as a seating part of the casing 3 is employed in the present embodiment. It is thus possible to lower the center of gravity of the keyboard device 1 and thereby to stabilize an installation state of the keyboard device 1.

On the other hand, in a case in which the base part speaker S is disposed in the base part 32, musical sound is emitted from a low position, and it is thus difficult to form a stereoscopic acoustic field space like in an acoustic grand piano. On the other hand, the present embodiment is configured to be able to form a stereoscopic acoustic field space through musical sound emission from the top lid 4 using vibration of vibrating bodies 5.

Figure 2:
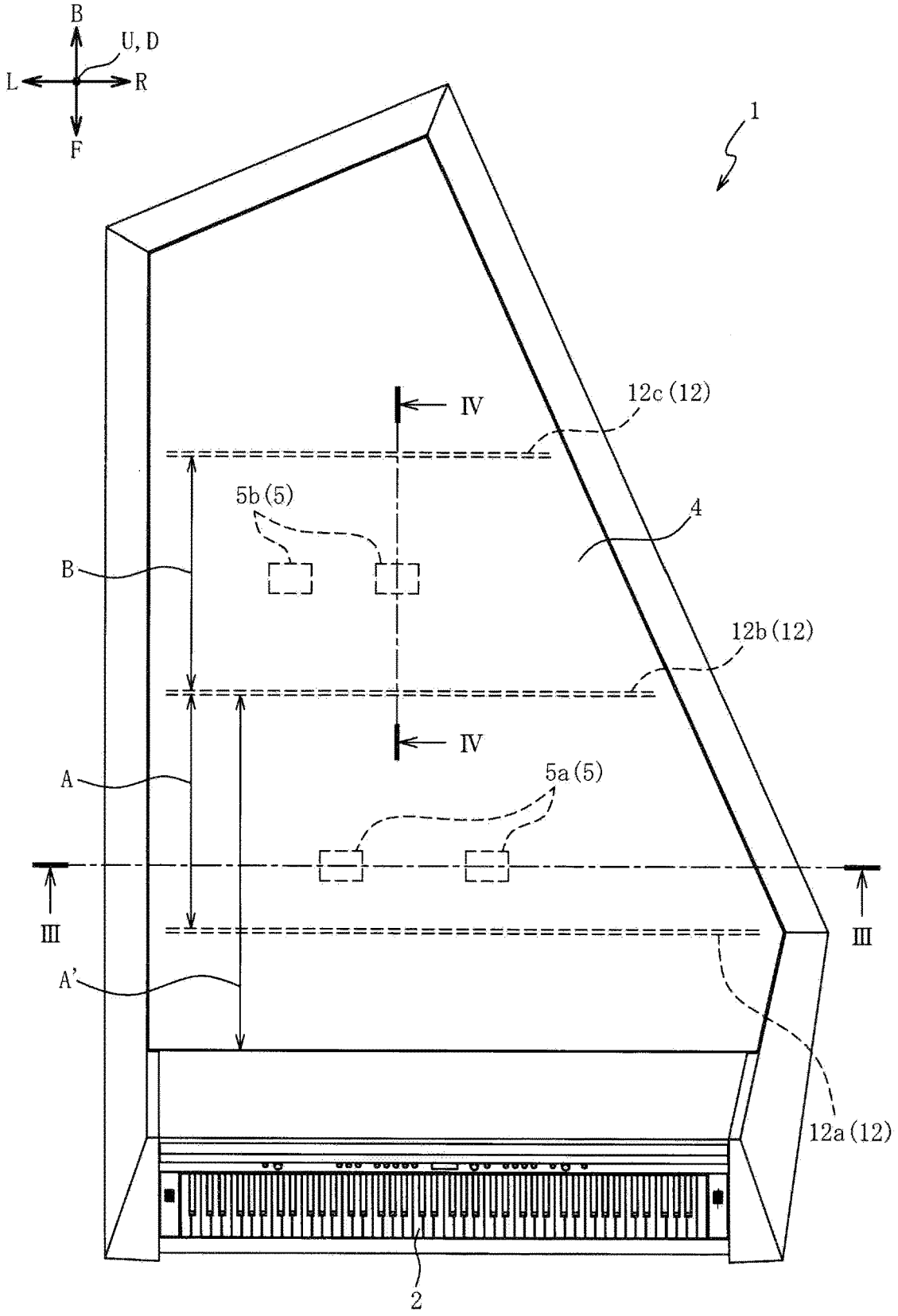
FIG. 2 is a top view of the keyboard device.
Figure 3:
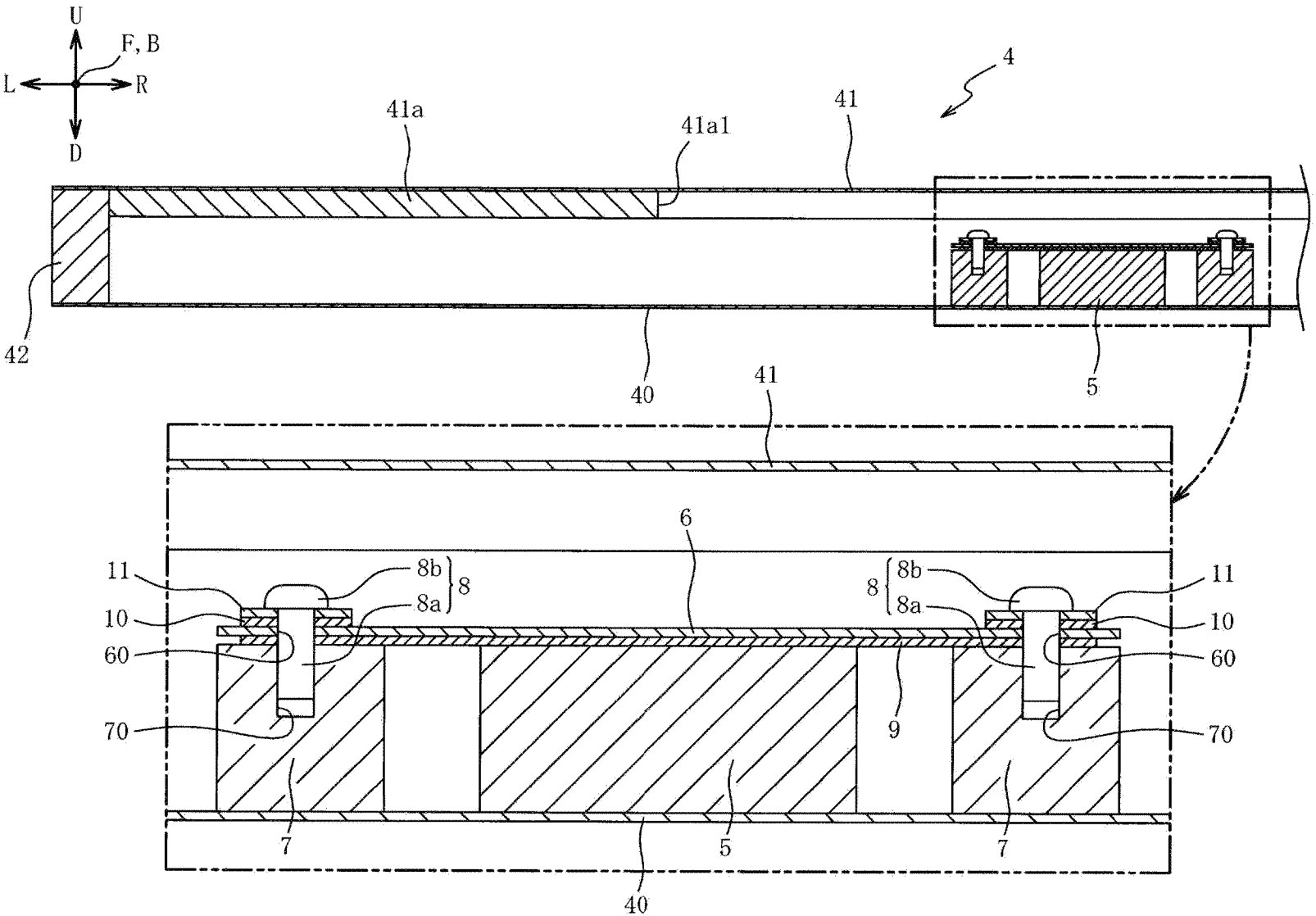
FIG. 3 is a partially enlarged sectional view along the line III-III in FIG. 2.

Detailed configurations of the top lid 4 and the vibrating bodies 5 will be described with reference to FIGS. 2 and 3, and the description will be given appropriately referring to FIG. 1 as well. FIG. 2 is a top view of the keyboard device 1, and FIG. 3 is a partially enlarged sectional view of the top lid 4 along the line III-III in FIG. 2.

As illustrated in FIG. 2, a plurality of (four in the present embodiment) vibrating bodies 5 is fixed to the top lid 4. The following description will be given by applying a reference sign 5*a* for the vibrating body disposed on the front side (the player side) beyond the center of the top lid 4 in the front-back direction and a reference sign 5*b* for the vibrating body disposed on the back side beyond the center of the top lid 4 in the front-back direction, out of the plurality of vibrating bodies 5. Also, the description will be given by describing the vibrating bodies 5*a* and 5*b* as the vibrating bodies 5 in a case in which these are not distinguished from each other.

The vibrating bodies 5 include magnetic circuits, voice coils, and the like and are, for example, drive devices (exciters) for causing a diaphragm of the speaker to vibrate. However, another known configuration can be employed as long as the configuration is a vibrator (an actuator or the like) capable of vibrating on the basis of musical sound signals.

The aforementioned musical sound signals based on pressing and releasing of the keys 2 (on/off of the switch) are also output to the vibrating bodies 5, and the vibrating bodies 5 attached to the top lid 4 also vibrate when the keys 2 are pressed. Therefore, the plate-shaped top lid 4 functions like a diaphragm of the speaker, and musical sound based on pressing of the keys 2 is thus generated through the vibration of the top lid 4. In this manner, it is possible to emit musical sound from a relatively high position through performance with the top lid 4 in the opened state as illustrated in FIG. 1 and thereby to form a stereoscopic acoustic field space like in an acoustic grand piano even in the case in which the base part speaker S is disposed in the base part 32.

Also, the sound emission direction of the base part speaker S is directed to the upper side (main body part 30 side), and the cavity H penetrating through the base part speaker S in the sound emission direction (up-down direction) is formed in the main body part 30. In other words, since the base part speaker S faces the cavity H in the up-down direction, the musical sound output from the base part speaker S passes through the cavity H of the main body part 30 and is emitted toward the top lid 4 in the opened state.

In the opened state of the top lid 4, the top lid 4 inclined relative to the horizontal direction is disposed to face the base part speaker S in the up-down direction (the sound emission direction of the base part speaker S), and it is thus possible to reflect the musical sound emitted through the cavity H by the top lid 4 and to emit the musical sound toward the side (arrow R side) of the keyboard device 1. This facilitates emission of the musical sound output from the base part speaker S to the surroundings of the keyboard device 1 (toward the audience side), and it is thus possible to form a stereoscopic acoustic field space like in an acoustic grand piano.

The vibrating bodies 5 and the vibrator of the base part speaker S vibrate on the basis of common musical sound signals generated when the keys 2 are pressed, and the present embodiment is configured such that a timing at which the vibration of the vibrating bodies 5 based on one (one-time) of the keys 2 is started (the top lid 4 starts sound emission) comes later than a timing at which the vibration of the vibrator of the base part speaker S is started (the base part speaker S starts sound emission). In other words, the embodiment is configured such that the emission of the musical sound from the top lid 4 continues for a predetermined time even after the emission of the musical sound from the base part speaker S stops. It is thus possible to achieve a sense of depth of the musical sound emitted from the top lid 4.

Moreover, the vibrator of the base part speaker S is configured to vibrate at frequencies that simulate attacking sound generated when strings of the acoustic piano are hit by hammers, and the vibrating bodies 5 are configured to vibrate at frequencies that simulates musical sound after the attacking sound, that is, vibrating sound of a sound board and a side plate of the acoustic piano. In this manner, it is possible to simulate the attacking sound with the musical sound emitted from the base part speaker S and to simulate sound after the attacking sound with the musical sound emitted from the top lid 4. Therefore, it is possible to simulate rich musical sound close to that of an acoustic grand piano.

As illustrated in FIG. 3, the top lid 4 to which the vibrating bodies 5 are fixed is formed into a hollow structure including the lower plate 40, an upper plate 41 facing the lower plate 40 on the upper side of the lower plate 40, and an outer circumferential wall 42 that connects outer edges of the lower plate 40 and the upper plate 41 on upper and lower sides. The lower plate 40 and the upper plate 41 are thin plates (plate of less than 3 mm) made of metal, a resin, or wood. Although not illustrated in the drawing, the outer edge parts of the lower plate 40 and the upper plate 41 are connected (coupled) over the entire circumference thereof on the upper and lower sides with the outer circumferential wall 42.

In this manner, since the top lid 4 is formed into the hollow structure by the lower plate 40, the upper plate 41, and the outer circumferential wall 42, and the vibrating bodies 5 are fixed to the inner surface (upper surface) of the lower plate 40, it is possible for the vibrating bodies 5 to cause the lower plate 40 to vibrate, and it is thus possible to emit musical sound generated through the vibration from the outer surface (lower surface) side of the lower plate 40. On the other hand, since musical sound emitted from the inner surface side of the lower plate 40 is blocked by the upper plate 41, it is possible to curb mutual canceling out of the musical sound in the opposite phases emitted from each of the inner surface and the outer surface of the lower plate 40. It is thus possible to efficiently emit the musical sound to the surroundings of the top top lid 4. Moreover, since the vibrating bodies 5 are provided inside the top lid 4, and the vibrating bodies 5 are not exposed to the outside of the top lid 4, it is possible to improve an appearance of the keyboard device 1.

Also, the lower plate 40 is a plate located on the lower surface side of the top lid 4 in the opened state of the top lid 4 (see FIG. 1). This facilitates emission of musical sound toward an audience on a side (the right side of the keyboard device 1 in the present embodiment) of the top lid 4 by causing the lower plate 40 to vibrate in the state in which the top lid 4 is caused to be opened.

The upper plate 41 includes a reinforcing material 41*a* that is caused to adhere to the inner surface thereof, and the upper plate 41 and the reinforcing material 41*a* integrally form one plate. Although illustration of the reinforcing material 41*a* is omitted in the hatching in FIG. 3, the reinforcing material 41*a* is a plate (honeycomb panel) made of aluminum with a honeycomb structure. Since the reinforcing material 41*a* is caused to adhere to substantially the entire region of the upper plate 41, the upper plate 41 is formed to have higher rigidity than the lower plate 40. In this manner, it is possible to curb vibration of the upper plate 41 due to vibration transmitted from the lower plate 40 and thereby to curb cancelation of the musical sound emitted from the lower plate 40 to the outside by musical sound caused by vibration of the upper plate 41. On the other hand, since the lower plate 40 has lower rigidity and is more easily bent than the upper plate 41, it is possible to facilitate the vibration of the lower plate 40 by the vibrating bodies 5. It is thus possible to efficiently emit the musical sound generated through the vibration of the lower plate 40 to the surroundings of the top lid 4.

A through-hole 41*a*1 is formed in a region of the reinforcing material 41*a* facing the vibrating bodies 5 on the upper and lower sides, and the reinforcing material 41*a* is not bonded to the upper plate 41 in a region in which the vibrating bodies 5 and the upper plate 41 face each other. Since this facilitates the vibration of the upper plate 41 in a vibrating region (the region where the vibrating bodies 5 are disposed) of the lower plate 40, vibration of the lower plate 40 is also facilitated in accordance with this (in a case in which it is difficult for the upper plate 41 to vibrate, it is necessary for the lower plate 40 to vibrate against an air pressure inside the top lid 4). It is thus possible to efficiently emit musical sound generated by the vibration of the lower plate 40 to the surroundings of the top lid 4.

Moreover, it is possible to curb contact of the vibrating bodies 5 with the reinforcing material 41*a* when the lower plate 40 vibrates by not bonding the reinforcing material 41*a* to the upper plate 41 in the region in which the vibrating bodies 5 face the upper plate 41. Therefore, it is possible to dispose the lower plate 40 and the upper plate 41 to be as close as possible and thereby to form the top lid 4 to be thin.

On the other hand, rigidity of the upper plate 41 is enhanced as a whole by fixing the reinforcing material 41*a* in the other region in which the vibrating bodies 5 do not face the upper plate 41 on the upper and lower sides. In this manner, it is possible to reduce vibration of the upper plate 41 as a whole and thereby to curb emission of musical sound from the upper surface side of the top lid 4.

As illustrated in the enlarged part of FIG. 3, the vibrating bodies 5 are fixed in a state in which the vibrating bodies 5 are sandwiched between the lower plate 40 and the plate 6. More specifically, the vibrating bodies 5 are caused to adhere (fixed) to the inner surface of the lower plate 40 with double-sided tapes (not illustrated) or the like, and fixation bases 7 for fixing the plate 6 are caused to adhere (fixed) to the lower plate 40 with double-sided tapes (not illustrated) or the like in the surroundings of the vibrating bodies 5.

The fixation bases 7 are formed into annular shapes surrounding the vibrating bodies, and a plurality of female screw holes 70 is formed in the upper surfaces of the fixation bases 7. The plate 6 is a thin plate made of metal or a resin, and a plurality of through-holes 60 is formed in the plate 6 at positions corresponding to the female screw holes 70 in the fixation bases 7. The plate 6 is fixed to the fixation bases 7 by screwing shaft parts 8*a* of screws 8 inserted into the through-holes 60 in the plate 6 into the female screw holes 70 in the fixation bases 7.

In the fixed state of the plate 6, the upper and lower facing interval between the lower plate 40 and the plate 6 is configured to be the same as (or slightly narrower than) the thickness (the dimension in the up-down direction) of the vibrating bodies 5. In this manner, it is possible to sandwich the vibrating bodies 5 between the lower plate 40 and the plate 6 and thereby to curb peeling-off of the adhesion between the vibrating bodies 5 and the lower plate 40 when the lower plate 40 vibrates. Also, since the vibrating bodies 5 is pressed against the lower plate 40 by the plate 6, it is possible to efficiently transmit the vibration of the vibrating bodies 5 to the lower plate 40. Therefore, it is possible to efficiently emit musical sound generated by the vibration of the lower plate 40 to the surroundings of the top lid 4.

A vibration-proofing material 9 (sound absorbing material) is caused to adhere to the lower surface of the plate 6, and the vibration-proofing material 9 is sandwiched between the vibrating bodies 5 and the plate 6. In this manner, it is possible to curb generation of abnormal noise due to contact between the vibrating bodies 5 and the plate 6 when the vibrating bodies 5 vibrate.

The vibration-proofing material 9 with a single sheet shape is caused to adhere to substantially the entire region of the lower surface of the plate 6, and holes continuing to the through-holes 60 in the plate 6 are also formed in the vibration-proofing material 9. In other words, the vibration-proofing material 9 is also sandwiched between the plate 6 and the fixation bases 7. In this manner, it is possible to curb generation of abnormal noise due to contact between the plate 6 and the fixation bases 7 when the plate 6 (vibrating bodies 5) vibrates. Also, since the annular vibration-proofing material 10 is also sandwiched between the plate 6 and head parts 8*b* of the screws 8, it is possible to curb generation of abnormal noise due to contact between the plate 6 and the head parts 8*b* of the screws 8 when the plate 6 (vibrating bodies 5) vibrates.

In this manner, it is possible to emit satisfactory musical sound to the surroundings of the top lid 4 by the vibration-proofing materials 9 and 10 reducing abnormal noise generated due to contact of each of the vibrating bodies 5, the plate 6, the fixation bases 7, and the head parts 8*b* of the screws 8.

Also, any material that is softer than the plate 6 and can block (or attenuate) the vibration of the plate 6 may be used as the vibration-proofing materials 9 and 10. For example, double-sided tapes with cushioning properties, elastic bodies (rubber), woven clothes such as felt, or the like may be used as the vibration-proofing materials 9 and 10.

Also, in a case in which the plate 6 is fixed with the screws 8, and the head parts 8*b* of the screws 8 bite into the vibration-proofing material 10 or rotation of the head parts 8*b* of the screws 8 is hindered by the vibration-proofing material 10, it is only necessary to provide washers 11 between the head parts 8*b* of the screws 8 and the vibration-proofing material 10 as in the present embodiment. The washers 11 are annular washers made of metal or a resin (that is harder than the vibration-proofing material 10), and it is possible to curb the vibration-proofing material 10 preventing the screws 8 from being screwed by causing the washers 11 to be interposed between the vibration-proofing material 10 and the head parts 8*b* of the screws 8.

Figure 4:
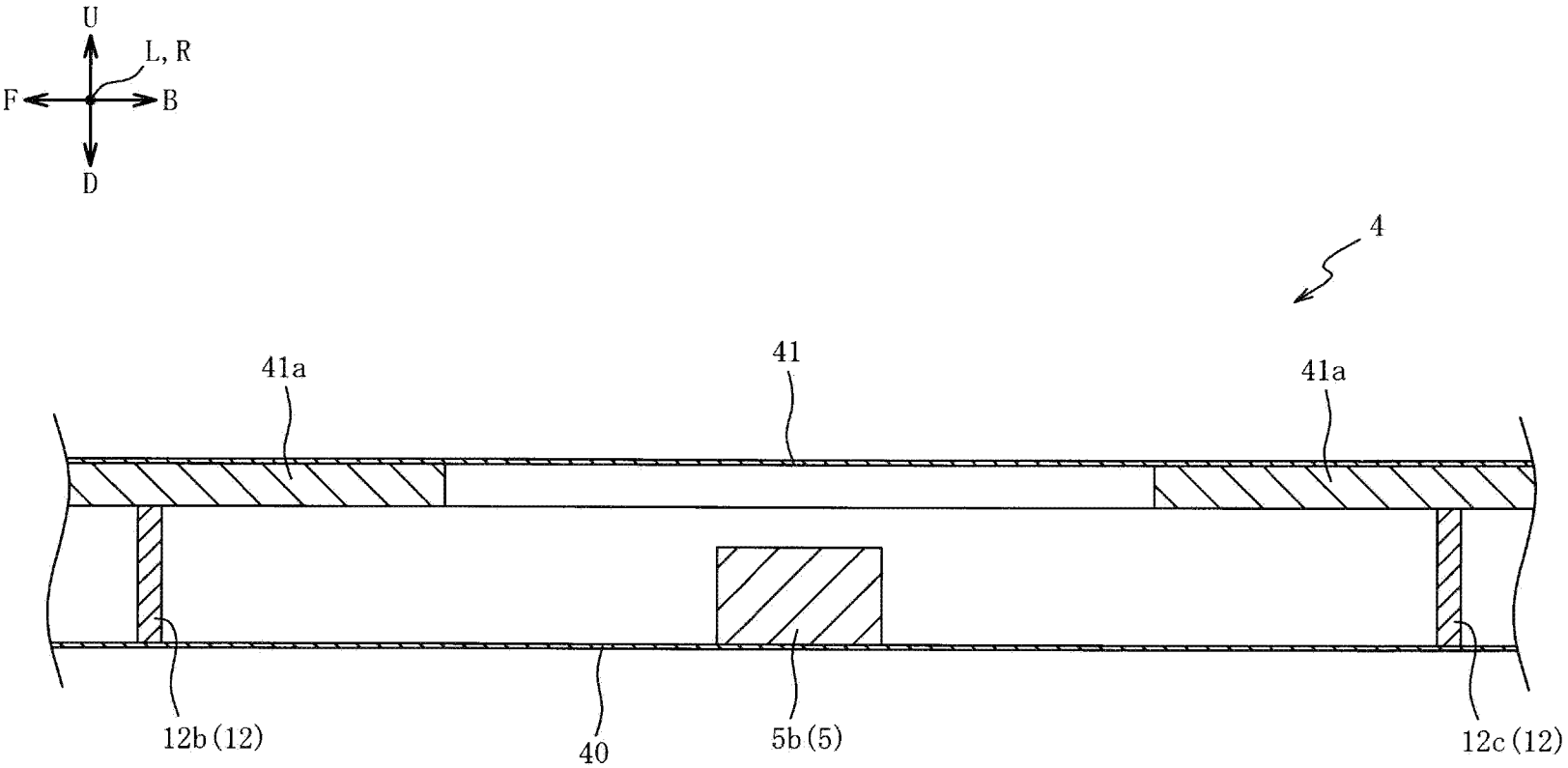
FIG. 4 is a partially enlarged sectional view of a top lid along the line IV-IV in FIG. 2.

Next, a configuration of sectioning members 12 will be described with reference to FIGS. 2 and 4. FIG. 4 is a partially enlarged sectional view of the top lid 4 along the IV-IV line in FIG. 2. In FIG. 4, illustration of the internal structure of the vibrating bodies 5 is omitted and hatched for simplification of the drawing.

As illustrated in FIGS. 2 and 4, a pair of vibrating bodies 5*a* are provided on the left and right sides at a predetermined interval, and a pair of vibrating bodies 5*b* are disposed on the left and right side at a predetermined interval behind the vibrating bodies 5*a*. Vibrating regions A and B in the top lid 4 vibrated by these plurality of vibrating bodies 5*a* and 5*b* are sectioned by the sectioning members 12. Although the following description will be given by applying a reference sign 12*a* for the sectioning member disposed in front of the vibrating bodies 5*a*, a reference sign 12*b* for the sectioning member disposed between the vibrating bodies 5*a* and the vibrating bodies 5*b*, and a reference sign 12*c* for the sectioning member disposed behind the vibrating bodies 5*b*, the description will be given by describing the sectioning members 12*a* to 12*c* as sectioning members 12 in a case in which the these are not distinguished from each other.

The sectioning members 12 are plates made of metal, a resin, or wood and caused to adhere (fixed) to the lower plate 40 of the top lid 4 with double-sided tapes (not illustrated) or the like. The sectioning members 12 are provided to extend in the left-right direction, and the sectioning members 12*a* to 12*c* serve as vibration nodes of the lower plate 40 when the vibrating bodies 5*a* and 5*b* vibrate. In other words, the portions of the lower plate 40 located between the sectioning members 12*a* to 12*c* serve as peaks and vibrate. Therefore, in a case in which the facing intervals of the sectioning members 12*a* to 12*c* are set to be relatively wide, for example, the vibrating regions A and B (vibrating areas) of the lower plate 40 including the sectioning members 12*a* to 12*c* as the nodes are widened, and the lower plate 40 thus more easily vibrates at low frequencies. Also, in a case in which the facing intervals of the sectioning members 12*a* to 12*c* are set to be relatively narrow, the lower plate 40 more easily vibrates at high frequencies.

In other words, it is possible to adjust the vibration areas of the lower plate 40 in accordance with the intervals of the sectioning members 12*a* to 12*c* by sectioning the vibrating regions A and B of the lower plate 40 vibrated by the vibrating bodies 5*a* and 5*b* with the sectioning members 12*a* to 12*c* as in the present embodiment. Therefore, it is possible to cause the lower plate 40 to easily vibrate at a target frequency.

In such a case in which the vibration areas of the lower plate 40 are adjusted, it is also possible to adjust how wide a vibrating region A' of the lower plate 40 is (to cause the lower plate 40 to vibrate with the outer circumferential wall 42 and the sectioning member 12*b* caused to serve as nodes) by omitting the sectioning member 12*a* and causing the interval between the outer circumferential wall 42 (see FIG. 1) of the top lid 4 and the sectioning member 12*b* to change, for example. However, in a case of such a configuration, it is necessary to dispose the vibrating bodies 5*a* to be close to the outer circumferential wall 42 to cause the vibrating region A' to have an area equivalent to that of the vibrating region A. Since the rigidity of the lower plate 40 is high and vibration is unlikely occur in the vicinity of the outer circumferential wall 42, it is difficult to cause the lower plate 40 to efficiently vibrate using the vibrating bodies 5*a*.

On the other hand, according to the present embodiment, the pairs of sectioning members 12*a* to 12*c* are provided with the vibrating bodies 5*a* and 5*b* sandwiched therebetween, and it is thus possible to cause how wide the vibrating regions A and B of the lower plate 40 are to change by adjusting the intervals between the sectioning members 12*a* and 12*b* and between the sectioning members 12*b* and 12*c*. In this manner, it is possible to dispose the vibrating bodies 5*a* and 5*b* at positions that are relatively far from the outer circumferential wall 42, that is, in a region where the lower plate 40 is easily bent as compared with the case in which wideness of the vibrating region A' of the lower plate 40 is changed depending on the interval between the outer circumferential wall 42 and the sectioning members 12*b*, and it is thus possible to set the vibrating regions A and B of the lower plate 40 to have desired areas. Therefore, it is possible to cause the lower plate 40 to efficiently vibrate with the vibrating bodies 5*a* and 5*b*.

Also, since the sectioning members 12 are in contact with the inner surface of the upper plate 41 (via the reinforcing material 41*a*) (see FIG. 4), the lower plate 40 easily vibrates with the sectioning members 12 caused to serve as the nodes. Therefore, it is possible to easily cause the lower plate 40 to vibrate at a target frequency. Moreover, it is possible to improve strength of the top lid 4 by bringing the sectioning members 12 and the upper plate 41 into contact with each other. In other words, it is possible to cause the sectioning members 12 to have the function as the vibration nodes of the lower plate 40 and the function of reinforcing the top lid 4.

Also, since the sectioning members 12 are provided to extend in the left-right direction (the arrow L-R direction), the top lid 4 can be effectively reinforced. In other words, since the top lid 4 rotates about the rotation axis along the front-back direction (see FIG. 1), an end part (the end part on the right side) of the top lid 4 in the left-right direction is easily bent in a suspended manner due to its self-weight in the opened state of the top lid 4. On the other hand, in the present embodiment, since the sectioning members 12 reinforcing the top lid 4 extend in the left-right direction (the direction that perpendicularly intersects the axial direction of the rotation axis of the top lid 4), it is possible to effectively prevent, with the sectioning members 12, the bending due to its self-weight in an opened state of the top lid 4.

On the other hand, since the sectioning members 12 are in contact with the upper plate 41 as described above, there is a concern that the vibration of the vibrating bodies 5 may be transmitted to the upper plate 41 via the sectioning members 12 and the upper plate 41 may vibrate due to the vibration. However, the sectioning members 12 are in contact with the upper plate 41 via the reinforcing material 41*a*. In other words, since the sectioning members 12 are in contact with the region where the rigidity of the upper plate 41 is enhanced with the reinforcing material 41*a*, it is possible to curb the vibration of the upper plate 41 due to the vibration transmitted via the sectioning members 12.

Here, in the present embodiment, the frequency at which the vibrating bodies 5*a* on the closer side that is closer to the player (the bandwidth of 400 to 1500 Hz in the present embodiment) is set to be a lower bandwidth than the frequency at which the vibrating bodies 5*b* on the further side when seen from the player (the bandwidth of 600 to 2000 Hz in the present embodiment). This is for simulating rich musical sound that is close to the one of an acoustic grand piano by allocating the vibrating frequencies to the vibrating bodies 5*a* and 5*b*. In this case, if a configuration in which the sectioning members 12*b* are not present is employed, for example, musical sound at different frequencies interferes with each other in an internal space of the top lid 4, and it is thus difficult to emit satisfactory musical sound to the surroundings of the top lid 4.

On the other hand, in the present embodiment, the vibrating region A of the lower plate 40 vibrated by the vibrating bodies 5*a* and the vibrating region B of the lower plate 40 vibrated by the vibrating bodies 5*b* are sectioned by the sectioning member 12*b*. In this manner, it is possible to curb the mutual interference of the musical sound even in a case in which the musical sound at different frequencies is emitted from the lower plate 40. Therefore, it is possible to emit satisfactory musical sound to the surroundings of the top lid 4.

Also, the vibration of the vibrating bodies 5*b* at a relatively high frequency is more quickly attenuated than the vibration of the vibrating bodies 5*a* at a relatively low frequency, and a time from sound generation to sound vanishing of the vibration of the vibrating bodies 5 is shorter. Therefore, if a configuration in which musical sound caused by the vibration of the vibrating bodies 5*a* and 5*b* reach the player at the same time is employed, for example, the musical sound caused by the vibration of the vibrating bodies 5*b* is attenuated (vanishes) earlier, and only the musical sound caused by the vibration of the vibrating bodies 5*a* is likely to remain as lingering sound.

On the other hand, although the timings at which the vibrating bodies 5*a* and 5*b* start to vibrate when the keys 2 are pressed are the same, the distance from the keys 2 to the vibrating bodies 5*b* is set to be longer than the distance from the keys 2 to the vibrating bodies 5*a* in the present embodiment. In other words, since the vibrating bodies 5*a* are disposed on the further side than the vibrating bodies 5*b* when seen from the player, it is possible to cause the musical sound caused by the vibration of the vibrating bodies 5*b* to be delivered to the player later than the musical sound caused by the vibration of the vibrating bodies 5*a*. In this manner, the attenuation (sound vanishing) timings of the musical sound caused by the vibration of the vibrating bodies 5*a* and 5*b* are likely to coincide when the musical sound caused by the vibration of the vibrating bodies 5*a* and 5*b* is listened near the player. Therefore, it is possible to leave the vibration (sound) from each of the vibrating bodies 5*a* and 5*b* as lingering sound and thereby to emit satisfactory musical sound to the player side.

Although the description has been given on the basis of the embodiment, the present disclosure is not limited to the aforementioned embodiment at all, and it is possible to appreciate that various improvements and modifications can be made without departing from the gist of the disclosure.

Figure 5:
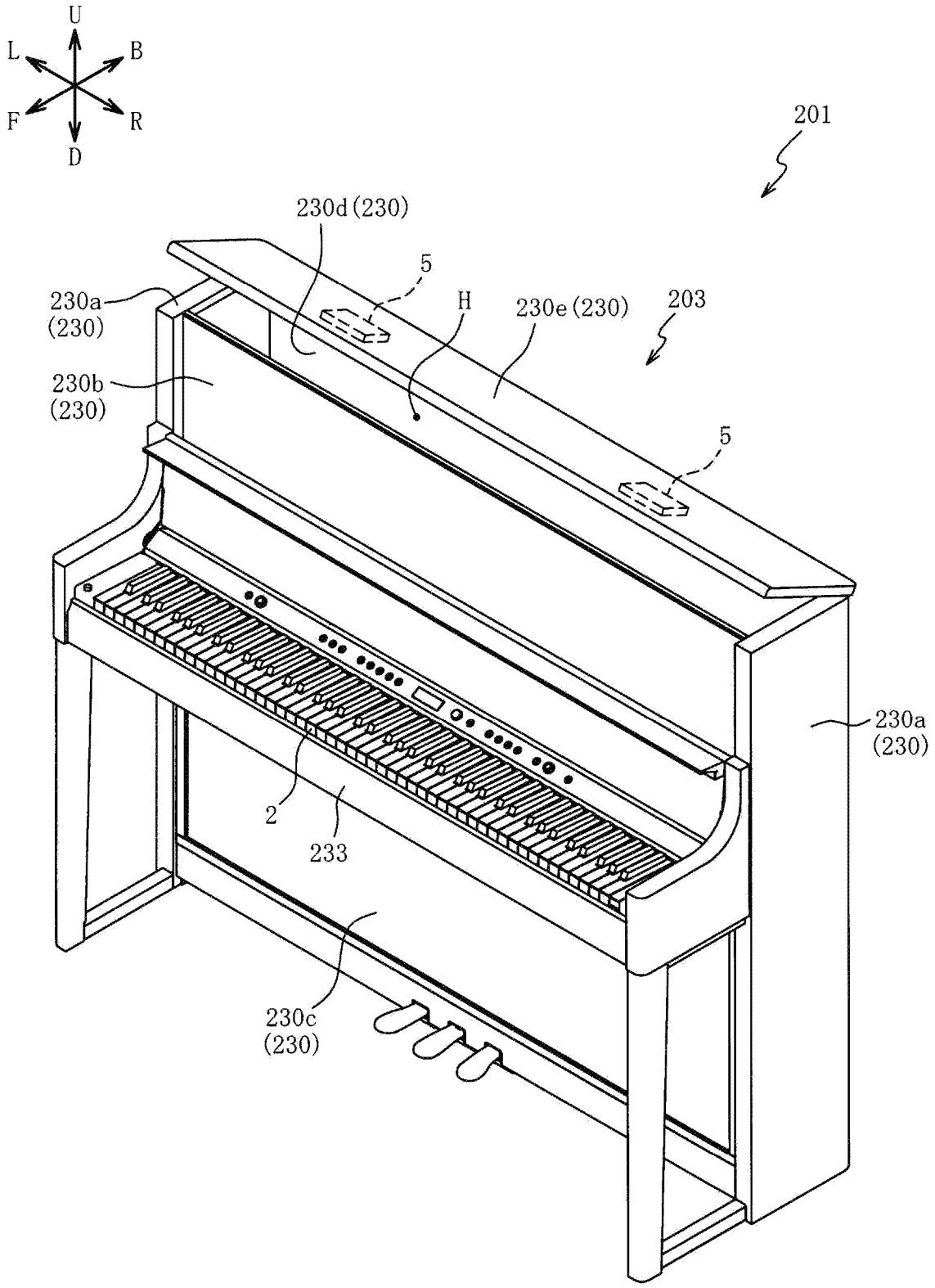
FIG. 5 is a front perspective view of a keyboard device according to a modification example.

Although the case in which the keyboard device 1 is a keyboard musical instrument (electronic piano) that simulates an acoustic grand piano and the vibrating bodies 5 are provided inside the top lid 4 of the keyboard device 1 has been described in the aforementioned embodiment, the disclosure is not necessarily limited thereto. For example, a configuration in which the technical idea of the aforementioned embodiment is applied to an upright-type keyboard musical instrument (electronic piano) may also be employed. An example of the configuration will be described as a modification example with reference to FIG. 5. FIG. 5 is a front perspective view of a keyboard device 201 according to the modification example. The same reference signs will be applied to the same components as those in the aforementioned embodiment, and description thereof will be omitted.

As illustrated in FIG. 5, a casing 203 of the keyboard device 201 includes a main body part 230 with a substantially rectangular parallelepiped shape and a keyboard table 233 projecting from the front surface of the main body part 230 and supporting a plurality of keys 2.

The main body part 230 includes a pair of side plates 230*a* disposed away from each other at a predetermined interval in the left-right direction (arrow L-R direction), an upper front plate 230*b* and a lower front plate 230*c* connecting the front ends (end parts on the arrow F side) of the pair of side plates 230*a* on the left and right sides, a back plate 230*d* that connects the back ends (end parts on the arrow B side) of the pair of side plates 230*a* on the left and right sides behind the upper front plate 230*b* and the lower front plate 230*c*, and a top plate 230*e* that is rotatably attached to the back plate 230*d* via a hinge, which is not illustrated.

The top plate 230*e* is a plate that opens and closes an upper end part of a cavity H surrounded by each plate, namely, the side plates 230*a*, the upper front plate 230*b*, the lower front plate 230*c*, and the back plate 230*d*. Although not illustrated, the top plate 230*e* is formed into a hollow structure by a lower plate, an upper plate, and an outer circumferential wall similarly to the top lid 4 in the first embodiment, and a pair of vibrating bodies 5 are fixed to the inner surface of the lower plate of the top plate 230*e*. Therefore, it is possible to emit musical sound generated by vibration of the top plate 230*e* from the outer surface (lower surface) side of the lower plate of the top plate 230*e* by the vibrating bodies 5 causing the top plate 230*e* to vibrate. On the other hand, musical sound emitted from the inner surface side of the lower plate of the top plate 230*e* is blocked by the upper plate of the top plate 230*e*, and it is thus possible to curb mutual cancelation of musical sound in opposite phases emitted from each of the inner surface and the outer surface of the lower plate of the top plate 230*e*. Therefore, it is possible to efficiently emit the musical sound to the surroundings of the top plate 230*e*.

Also, the lower plate of the top plate 230*e* is a plate located on the lower surface side of the top plate 230*e* (directed to the side of the keys 2) in an opened state of the top plate 230*e*. Therefore, musical sound is more easily emitted to the player in front of the top plate 230*e* or audience by the vibrating bodies 5 causing such a lower plate to vibrate.

Although the configuration in which the top plate 230*e* has a hollow structure and the vibrating bodies 5 are fixed to the inside of the top plate 230*e* has been exemplified as the modification example, a configuration in which the side plates 230*a* axially supported by the back plate 230*d* may have hollow structures and the vibrating bodies 5 are fixed to the inside of the side plates 230*a*, for example, may also be employed. It is preferable to fix the vibrating bodies 5 to the inner surfaces of the plates of the side plates 230*a* directed to the side of the keys 2 (front side) in the opened state of the side plates 230*a* in this case as well. In this manner, musical sound is more easily emitted to the player in front of the side plates 230*a* and the audience through the vibration of such plates.

Also, although the case in which the vibrating bodies 5 are attached to the plate that opens and closes the casing 203 of the upright-type keyboard device 201 has been described in the aforementioned modification, and the case in which the vibrating bodies 5 are attached to the plate that opens and closes the casing 3 of the grand piano-type keyboard device 1 has been described in the aforementioned embodiment, the disclosure is not necessarily limited thereto. The technical idea of the aforementioned embodiment can be applied to any keyboard device as long as the keyboard device has at least a casing that supports the keys 2 and a part of the casing is opened and closed with a plate-shaped opening/closing member. Therefore, the disclosure is not limited to the keyboard device in which a part of the casing is opened and closed through rotation of the opening/closing member and may be a keyboard device in which a part of the casing is opened and closed through sliding of the opening/closing member.

Also, although the case in which the vibrating bodies 5 are fixed to the inner surface of the plate located on the lower surface side of the top plate 230*e* in the opened state of the top plate 230*e* has been described in the aforementioned modification example, and the case in which the vibrating bodies 5 are fixed to the inner surface of the lower plate 40 of the top lid 4 has been described in the aforementioned embodiment, the disclosure is not necessarily limited thereto. For example, a configuration in which the vibrating bodies 5 are fixed to the inner surface of the plate located on the upper surface side of the top plate 230*e* in the opened state in which the top plate 230*e* or the inner surface of the upper plate 41 of the top lid 4 may be employed.

Although the case in which the upper plate 41 is formed to have higher rigidity than the lower plate 40 has been described in the aforementioned embodiment, the disclosure is not necessarily limited thereto. The lower plate 40 and the upper plate 41 may have the same rigidity, or the lower plate 40 may have higher rigidity than the upper plate 41.

Although the case in which the rigidity of the upper plate 41 is enhanced by causing the reinforcing material 41*a* to adhere (bonded) to the upper plate 41 has been described in the aforementioned embodiment, the disclosure is not necessarily limited thereto. For example, the reinforcing material 41*a* may be omitted, and the upper plate 41 itself may be formed to have a thicker thickness than the lower plate 40 to enhance the rigidity.

Although the configuration in which the reinforcing material 41*a* is not bonded to the upper plate 41 in the region in which the vibrating bodies 5 and the upper plate 41 face each other has been described in the aforementioned embodiment, a configuration in which the reinforcing material 41*a* and the upper plate 41 are formed to have thicker thicknesses in such a region than in the other region may be employed, for example. It is possible to curb contact of the vibrating bodies 5 with the upper plate 41 and the reinforcing material 41*a* when the lower plate 40 vibrates with this configuration as well, and it is thus possible to dispose the lower plate 40 and the upper plate 41 to be as close to each other as possible.

Although the case in which the vibrating bodies 5 are configured with the four vibrating bodies 5*a* and 5*b* has been described in the aforementioned embodiment, a configuration in which one to three or five or more vibrating bodies 5 (5*a* and 5*b*) are fixed to the inside of the top lid 4 may also be employed.

Although the case in which the frequency (in the bandwidth of 400 to 1500 Hz) at which the vibrating bodies 5 are caused to vibrate is set to be in a lower bandwidth than that of the frequency (in the bandwidth of 600 to 2000 Hz) at which the vibrating bodies 5*b* are caused to vibrate has been described in the aforementioned embodiment, the disclosure is not necessarily limited thereto. For example, such bandwidths may be the same for the vibrating bodies 5*a* and 5*b*, or the frequency bandwidth in which the vibrating bodies 5*a* are caused to vibrate may be set to be higher than that for the vibrating bodies 5*b*. In other words, the frequency bandwidth in which the vibrating bodies 5*a* are caused to vibrate can appropriately be set, and it is possible to emphasize attacking sound or to emphasize lingering sound after the attacking sound by adjusting allocation of the vibrating frequencies for the vibrating bodies 5*a* and 5*b*.

Although the case in which the distance from the keys 2 to the vibrating bodies 5*b* is set to be longer than the distance from the keys 2 to the vibrating bodies 5*a* has been described in the aforementioned embodiment, the disclosure is not necessarily limited thereto. For example, the vibrating bodies 5*b* may be disposed at positions closer to the keys (on the player side) than the vibrating bodies 5*a*, and the distances from the keys 2 to the vibrating bodies 5*a* and 5*b* may be the same. In other words, the disposition of the vibrating bodies 5*a* and 5*b* can appropriately be set.

Although the case in which the timing at which the top lid 4 starts to emit sound when the keys 2 are pressed is configured to come later than the timing at which the base part speaker S starts to emit sound has been described in the aforementioned embodiment, the disclosure is not necessarily limited thereto. For example, the timing at which the top lid 4 starts to emit sound may come earlier than the timing at which the base part speaker S starts to emit sound, or the timings at which the sound emission is started may be the same.

Although the case in which the timings at which the vibrating bodies 5*a* and 5*b* start to vibrate when the keys 2 are pressed are the same has been described in the aforementioned embodiment, the disclosure is not necessarily limited thereto. For example, a configuration in which the timing at which the vibrating bodies 5*b* start to vibrate comes later or earlier than that of the vibrating bodies 5*a* may be employed. It is possible to achieve a sense of depth of musical sound emitted from the top lid 4 with the configuration in which the timing at which the vibrating bodies 5*b* start to vibrate comes later than that of the vibrating bodies 5*a*.

Although the case in which the vibrating bodies 5 are caused to vibrate (the base part speaker S is caused to emit musical sound) on the basis of the musical sound signals when the keys 2 are pressed has been described in the aforementioned embodiment, the disclosure is not necessarily limited thereto. For example, a configuration in which the vibrating bodies 5 are caused to vibrate (the base part speaker S is caused to emit musical sound) on the basis of signals of musical sound data incorporated (stored) in the keyboard devices 1 and 201 or musical sound signals input from the outside to the keyboard devices 1 and 201 may also be employed. In other words, signals for causing the vibrating bodies 5 to vibrate (causing the base part speaker S to emit musical sound) are not limited to the musical sound signals generated when the keys 2 are pressed.

Although the case in which the vibrating regions A and B of the lower plate 40 vibrated by the vibrating bodies 5 are sectioned by the sectioning members 12 has been described in the aforementioned embodiment, the disclosure is not necessarily limited thereto. For example, the sectioning members 12 may be omitted.

Although the case in which pairs of sectioning members 12*a* to 12*c* are provided with the vibrating bodies 5*a* and 5*b* sandwiched therebetween has been described in the aforementioned embodiment, the disclosure is not necessarily limited thereto. For example, the areas of the vibrating regions A and B of the lower plate 40 may be adjusted only with the sectioning members 12*b*. Also, a configuration in which yet further sectioning members 12 are added in addition to the sectioning members 12*a* to 12*c* may also be employed.

Although the case in which the sectioning members 12 are in contact with the upper plate 41 via the reinforcing material 41*a* has been described in the aforementioned embodiment, the disclosure is not necessarily limited thereto. In a case in which the reinforcing material 41*a* is omitted, for example, the sectioning members 12 may be brought into direct contact with the upper plate 41, or a configuration in which the upper plate 41 (reinforcing material 41*a*) and the sectioning members 12 are kept in a non-contact state may also be employed.

Although the case in which the vibrating bodies 5 are fixed with the plate 6 and the fixation bases 7 has been described in the aforementioned embodiment, the disclosure is not necessarily limited thereto. For example, the plate 6 and the fixation bases 7 may be omitted.

Although the configuration in which the vibration-proofing material 9 is sandwiched between the vibrating bodies 5 and the plate 6 and between the plate 6 and the fixation base 7 and the case in which the vibration-proofing material 10 is sandwiched between the plate 6 and the head parts 8*b* of the screws 8 have been described in the aforementioned embodiment, the disclosure is not necessarily limited thereto. For example, a configuration in which the vibration-proofing materials 9 and 10 are omitted may also be employed. Also, configurations corresponding to the vibration-proofing materials 9 and 10 may be sandwiched between the lower plate 40 and the upper plate 41 and between the lower plate 40 (upper plate 41) and the outer circumferential wall 42, and with this configuration, it is possible to curb generation of abnormal noise due to contact of the lower plate 40, the upper plate 41, and the outer circumferential wall 42. Also, the configurations corresponding to the vibration-proofing materials 9 and 10 may be wound around wirings of the vibrating bodies 5, and with this configuration, it is possible to curb generation of abnormal noise due to contact of the wirings of the vibrating bodies 5 and the lower plate 40.

Although the case in which the plate 6 is fixed to the fixation bases 7 with the screws 8 has been described in the aforementioned embodiment, the disclosure is not necessarily limited thereto. For example, a configuration in which the plate 6 is fixed to the fixation bases 7 using other fastening members with shaft parts and head parts having a larger outer diameter than the shaft parts, such as rivets, may also be employed. In a case in which such fastening members having the shaft parts and the head parts are used, it is preferable to provide vibration-proofing materials between the plate 6 and the head parts of the fastening members similarly to the aforementioned embodiment. In this manner, it is possible to curb generation of abnormal noise due to contact between the plate 6 and the head parts of the fastening members when the plate 6 (vibrating bodies 5) vibrates.

Although the case in which the plate 6 (restriction member) and the fixation bases 7 are separate members has been described in the aforementioned embodiment, the disclosure is not necessarily limited thereto. For example, a configuration in which the plate 6 and the fixation bases 7 are integrated (one component) may also be employed.

Although the plate-shaped plate 6 has been exemplified as an example of the restriction member in the aforementioned embodiment, the disclosure is not necessarily limited thereto. The restriction member may be configured using a component other than the plate-shaped plate 6 as long as the component can press the vibrating bodies 5 against the lower plate 40 (restricting falling-off of the vibrating bodies 5).

Although the case in which the base part speaker S is provided in the base part 32 of the casing 3 has been described in the aforementioned embodiment, the disclosure is not necessarily limited thereto. For example, a configuration in which the base part speaker S is provided at the keyboard table 30*a*, the transverse frame 30*b*, or the back frame 30*c* of the casing 3 may also be employed. In other words, disposition of the speaker (casing speaker) in the casings 3 and 203 can appropriately be set.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A keyboard device comprising:

a casing;

an opening/closing member that opens and closes a part of the casing; and vibrating bodies that are attached to the opening/closing member and vibrate on a basis of a musical sound signal when a key is pressed, wherein the opening/closing member is formed into a hollow structure including a first plate and a second plate facing the first plate, and the opening/closing member is caused to vibrate to emit musical sound through vibration of the vibrating bodies fixed to an inner surface of the first plate.

2. The keyboard device according to claim 1, wherein the first plate is a plate located on a lower surface side of the opening/closing member or a plate facing a key side in a state in which the opening/closing member opens the part of the casing.

3. The keyboard device according to claim 2, wherein the second plate is formed to have higher rigidity than the first plate.

4. The keyboard device according to claim 3, wherein the second plate is formed to have higher rigidity than the first plate by a plate-shaped reinforcing material being bonded to an inner surface of the second plate, and the reinforcing material is formed to have a thinner thickness in a region in which the vibrating bodies face the second plate than in the other region, or the reinforcing material is not bonded to the second plate in the region in which the vibrating bodies and the second plate face each other.

5. The keyboard device according to claim 1, further comprising:

sectioning members that are fixed to the inner surface of the first plate and section vibrating regions of the first plate vibrated by the vibrating bodies.

6. The keyboard device according to claim 5, wherein a pair of the sectioning members are provided with the vibrating bodies sandwiched therebetween.

7. The keyboard device according to claim 5, wherein the second plate and the sectioning members are brought into contact with each other.

8. The keyboard device according to claim 5, wherein the vibrating bodies are configured at least with a first vibrating body and a second vibrating body that vibrates in a higher frequency bandwidth than the first vibrating body, and a vibrating region of the first plate vibrated by the first vibrating body and a vibrating region of the first plate vibrated by the second vibrating body are sectioned by the sectioning members.

9. The keyboard device according to claim 8, wherein a distance from keys to the second vibrating body is set to be longer than a distance from the keys to the first vibrating body.

10. The keyboard device according to claim 5, wherein the opening/closing member opens and closes the part of the casing through rotating about a rotation axis along a horizontal direction, and the sectioning members are provided to extend in a direction that perpendicularly intersects an axial direction of the rotation axis.

11. The keyboard device according to claim 1, further comprising:

fixation bases that are fixed to an inner surface of the first plate; and a restriction member that is supported by the fixation bases in a state in which the restriction member is separated from the first plate by a predetermined interval, wherein the vibrating bodies are fixed to the inner surface of the first plate in a state in which the vibrating bodies are sandwiched between the first plate and the restriction member.

12. The keyboard device according to claim 11, further comprising:

a vibration-proofing material that is sandwiched between the vibrating bodies and the restriction member.

13. The keyboard device according to claim 11, further comprising:

a fastening member that has a shaft part and a head part with a larger outer diameter than the shaft part and fastens the restriction member to the fixation bases;

a first vibration-proofing material that is sandwiched between the fixation bases and the restriction member; and a second vibration-proofing material that is sandwiched between the head part of the fastening member and the restriction member.

14. The keyboard device according to claim 1, further comprising:

a casing speaker that is provided in the casing and emits musical sound based on the musical sound signals, wherein a timing at which sound emission of the opening/closing member starts when a key is pressed is configured to come later than a timing at which sound emission of the casing speaker starts.

15. The keyboard device according to claim 1, wherein the casing comprises a main body part to which the opening/closing member is attached, leg parts extending downward from the main body part, and a base part that supports the main body part via the leg parts, the base part comprises a base part speaker that emits musical sound based on the musical sound signals toward the main body part, the main body part comprises a cavity penetrating through the base part speaker in a sound emission direction, and an opening part of the cavity on an upper end side is opened and closed by the opening/closing member.

16. A musical sound emission method for a keyboard device, wherein the keyboard device comprises:

a casing, an opening/closing member that opens and closes a part of the casing, and vibrating bodies that are attached to the opening/closing member and vibrate on a basis of a musical sound signal when a key is pressed, the method comprising:

forming the opening/closing member into a hollow structure comprising a first plate and a second plate facing the first plate; and causing the opening/closing member to vibrate to emit musical sound through vibration of the vibrating bodies fixed to an inner surface of the first plate.

17. The method according to claim 16, wherein in a case when the opening/closing member opens the part of the casing, the first plate is located on a lower surface side of the opening/closing member or facing a key side.

18. The method according to claim 17, wherein the second plate is formed to have higher rigidity than the first plate.

19. The method according to claim 18, wherein the second plate is formed to have higher rigidity than the first plate by a plate-shaped reinforcing material being bonded to an inner surface of the second plate.

20. The method according to claim 19, wherein the reinforcing material is formed to have a thinner thickness in a region in which the vibrating bodies face the second plate than in the other region, or the reinforcing material is not bonded to the second plate in the region in which the vibrating bodies and the second plate face each other.

* * * * *